US006293836B1

(12) United States Patent
Blanchard

(10) Patent No.: US 6,293,836 B1
(45) Date of Patent: Sep. 25, 2001

(54) WATER JET PROPULSION UNIT WITH MEANS FOR VARYING AREA OF NOZZLE OUTLET

(75) Inventor: Clarence E. Blanchard, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/536,497

(22) Filed: Mar. 27, 2000

(51) Int. Cl.[7] ..... B63H 11/103
(52) U.S. Cl. ..... 440/47; 440/38
(58) Field of Search ..... 440/47, 38, 40, 440/41, 42

(56) References Cited

U.S. PATENT DOCUMENTS

| | | | | |
|---|---|---|---|---|
| 3,214,903 | | 11/1965 | Cochran | 60/35.5 |
| 3,279,704 | | 10/1966 | Englehart et al. | 239/265.43 |
| 3,286,641 | | 11/1966 | Delao et al. | 103/93 |
| 3,424,121 | | 1/1969 | Thomas et al. | 114/151 |
| 3,637,140 | * | 1/1972 | Palovchik | 239/265.43 |
| 3,650,110 | * | 3/1972 | Ghougasian | 60/230 |
| 3,834,626 | * | 9/1974 | Sevik et al. | 239/265.13 |
| 4,331,173 | | 5/1982 | Culaud | 137/219 |
| 4,479,507 | | 10/1984 | Nichols | 137/220 |
| 5,244,425 | | 9/1993 | Tasaki et al. | 440/47 |
| 5,679,035 | * | 10/1997 | Jordan | 440/47 |

FOREIGN PATENT DOCUMENTS

| | | | | |
|---|---|---|---|---|
| 576223 | * | 5/1959 | (CA) | 440/47 |
| 58-139895 | * | 8/1983 | (JP) | 440/38 |
| 1-262290 | * | 10/1989 | (JP) | 440/47 |
| 2-128993 | * | 5/1990 | (JP) | 440/47 |
| 406001288 | * | 1/1994 | (JP) | 440/47 |
| 406001289 | * | 1/1994 | (JP) | 440/42 |

* cited by examiner

*Primary Examiner*—S. Joseph Morano
*Assistant Examiner*—Ajay Vasudeva
(74) *Attorney, Agent, or Firm*—Dennis M. Flaherty

(57) ABSTRACT

A water jet apparatus for propelling a boat. The water jet apparatus has a mechanism for adjusting the size of the outlet of the exit nozzle. The size of the outlet is increased to provide initial thrust and decreased for high speed. A smaller opening is also desirable for low-speed maneuvering. A cone made of resilient material is mounted to the stator hub. A hydraulically driven piston causes the resilient cone to elongate. This changes the shape of the cone and the position of the cone in relation to the exit nozzle outlet. When the resilient cone is elongated, the area of the exit nozzle outlet is decreased.

31 Claims, 3 Drawing Sheets

WATER JET PROPULSION UNIT WITH MEANS FOR VARYING AREA OF NOZZLE OUTLET

FIELD OF THE INVENTION

This invention generally relates to water jet apparatus for propelling boats and other watercraft. In particular, the invention relates to mechanisms for varying the outlet area of the exit nozzle of a water jet apparatus.

BACKGROUND OF THE INVENTION

It is known to propel a boat or other watercraft using a water jet apparatus mounted to the hull, with the powerhead being placed inside (inboard) or outside (outboard) the hull. The drive shaft of the water jet apparatus is coupled to the output shaft of the motor. The impeller is mounted on the drive shaft and installed in a housing, the interior surface of which defines a water tunnel. The impeller is designed such that during motor operation, the rotating impeller impels water rearward through the water tunnel. The reaction force propels the boat forward.

The overall performance of a water jet propulsion system is highly dependent on the size, i.e., area, of the exit nozzle outlet. A relatively large opening is required to provide initial thrust, whereas a relatively small opening is desirable for high speed. A smaller opening is also desirable for low-speed maneuvering, as it would result in a higher velocity of the exiting water flow at low engine rpm. Consequently, an adjustable exit nozzle outlet would be desirable to provide improved overall performance.

Some conventional adjustable exit nozzles for water jet propulsion systems have been designed using the iris method for opening or closing down the exit nozzle outlet, thereby increasing or decreasing the diameter of the outlet. While these means produce the desired results, an iris-type structure has a tendency to clog with silt or debris present in the water being pumped through the water jet propulsion system. This clogging eventually causes the adjustment mechanism to become inoperable.

Another technique for providing an adjustable exit nozzle outlet area is disclosed in U.S. Pat. No. 5,244,425 to Tasaki et al. An arrangement is provided for variably adjusting the effective flow area along a region within a water jet propulsion system. A bullet-shaped adjusting cone is moveable in and out of the outlet region, thereby adjusting the area of the outlet region. The adjusting cone is housed with a hub of the impeller assembly. A front portion of the cone member is flanged and forms an actuator. A spring is also housed within the hub, around a shaft connecting the cone portion and the actuator, and provides a forward biasing force against the actuator, thereby positioning the adjusting cone out of the outlet region and maximizing the outlet region's area. A rod and lever assembly is used to overcome the spring force, thereby moving the adjusting cone rearwardly and into the outlet region in order to reduce the area of that region.

Another type of variable nozzle employs a resilient or elastic member which can be expanded and contracted by the supply and withdrawal of a fluid from a chamber formed by the elastic member. For example, U.S. Pat. No. 3,279,704 to Englehart et al. discloses a water jet device which incorporates a control element which is moveable in and out of the outlet region and an annular flexible member made of rubber or like material which is installed in the outlet region. The flexible member and the outlet region form an internal hollow portion within which fluid pressure can be varied to adjust the position of the flexible member, thereby adjusting the thickness of the annular flow of water between the control element and the flexible member.

There is a need for a means by which the area of the exit nozzle outlet of a water jet propulsion system can be adjusted without the possibility of clogging, without use of a complicated linkage system and without redesigning the exit nozzle itself.

SUMMARY OF THE INVENTION

The present invention is directed to a water jet apparatus having means for adjusting the size of the outlet of the exit nozzle. The size of the outlet is increased to provide initial thrust and decreased for high speed. A smaller opening is also desirable for low-speed maneuvering.

In accordance with the preferred embodiment of the invention, means for adjusting the size of the outlet of the exit nozzle are mounted to the inner stator hub of a water jet propulsion system. The adjusting means comprise a bullet-shaped tail cone made of resilient or elastic material, e.g., molded rubber, and a hollow piston which is axially slidable relative to the inner stator hub. The piston is slidably mounted on an axial cylinder, the piston and cylinder forming a chamber between the distal end of the cylinder and the inner wall of the hollow piston. That chamber is in flow communication with a source of fluid via a conduit which penetrates the cylinder. The piston is hydraulically activated by supplying pressurized fluid to the chamber. The axial pressure exerted by the fluid in the chamber causes the piston to slide axially to an extended position. During rearward axial travel of the piston from its retracted position to its extended position, the tip of the piston bears against the internal surface of the resilient tail cone and carries the tip of the tail cone with it. This causes the resilient cone to elongate as the tip of the tail cone travels axially rearward while the base of the tail cone remains stationary. The piston and tail cone are configured, sized and positioned so that in an elongated position, the tail cone protrudes into the exit nozzle outlet, thereby efficiently reducing the area of the nozzle outlet. The elastic nature of the tail cone material will cause the cone to return to its unelongated configuration when the hydraulic pressure is relieved, e.g., by opening a hydraulic valve, thereby increasing the area of the nozzle outlet.

The preferred embodiment of the invention will be disclosed in the context of water jet propulsion system which is driven by an inboard motor. However, the person skilled in the art will readily appreciate that the adjustable nozzle disclosed herein has application beyond water jet propulsion systems driven by an inboard motor. For example, the adjustable nozzle disclosed herein has application in a water jet propulsion system driven by an outboard motor.

DETAILED DESCRIPTION OF THE PREFERRED EMBODIMENTS

Figure 1:
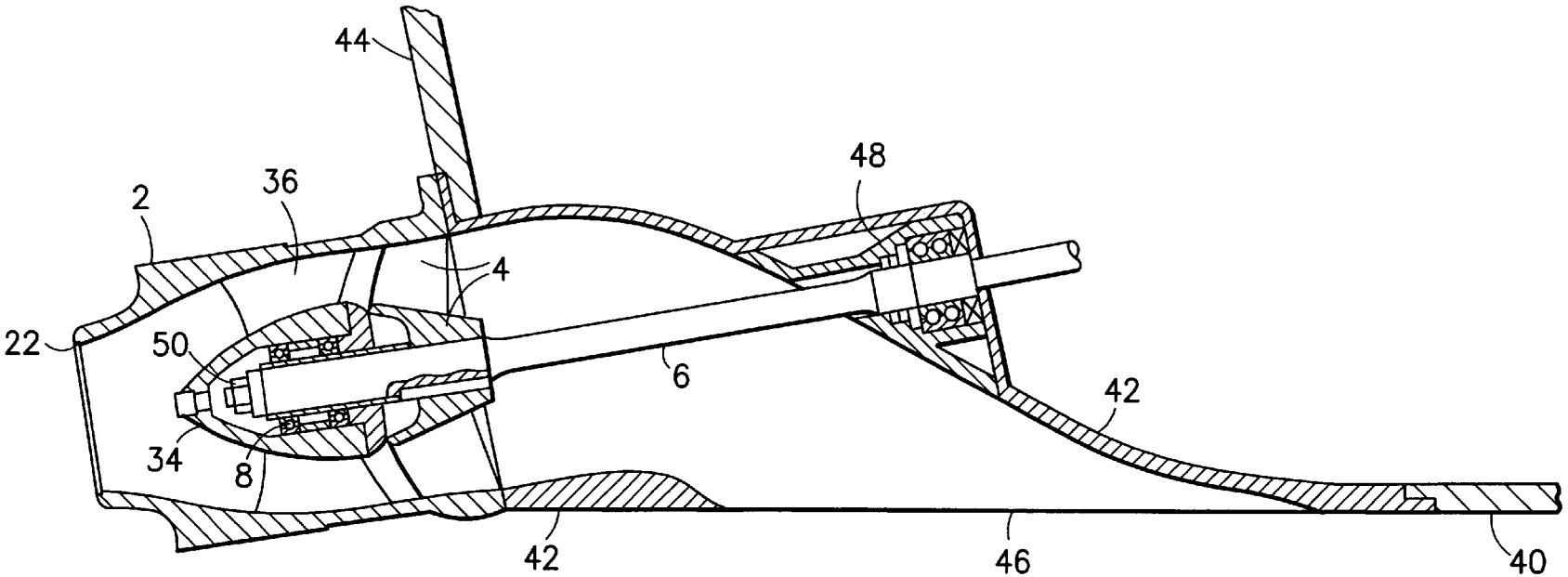
FIG. 1 PRIOR ART
FIG. 1 is a schematic showing an elevational sectional view a conventional water jet propulsion system.

FIG. 1 depicts a conventional water jet apparatus mounted to a boat. The boat has a hull 40 with a water tunnel 42 installed in its stern. The water tunnel 42 has a height which gradually increases from its starting point to a maximum height located at the transom 44 of the hull. The water tunnel 42 is installed in an opening in the hull. The intake 46 of the water tunnel 42 lies generally in the plane of the bottom of hull 40 while the outlet of the water tunnel 42 lies generally in the plane of the transom 44.

In addition, the boat partially depicted in FIG. 1 comprises an outboard water jet propulsion unit having an inlet which is in flow communication with the outlet of the water tunnel 42. The water jet propulsion unit is powered by an inboard engine (not shown) by means of a drive shaft 6. The drive shaft 6 is rotatably mounted in a conventional fashion, e.g., by a first set of bearings installed in a bearing housing 48 mounted to the water tunnel and by a second set of bearings 8 installed in a stator hub 34 of the water jet propulsion unit.

An impeller 4 comprising a hub and a plurality of blades is mounted near the end of the drive shaft 6. The hub and blades of impeller 4 are preferably integrally formed as one cast piece. As indicated by the cutaway portion of the drive shaft 6 seen in FIG. 1, the hub of impeller 4 and the drive shaft 6 are keyed so that the impeller will rotate in unison with the driveshaft. Alternatively, the impeller hub can be provided with a splined bore which meshes with splines formed on the external surface of the drive shaft. The impeller 4 is held securely on the drive shaft 6 by means of a lock nut 50 tightened onto a threaded end of the drive shaft 6. As seen in FIG. 1, the hub of the impeller 4 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The water jet propulsion unit shown in FIG. 1 also comprises a stator housing 2 which surrounds the impeller blades. The inner surface of the stator housing 2 forms the radially outer boundary for guiding the flow of water impelled by the impeller. The stator housing 2 has an inlet in flow communication with the outlet of the water tunnel 42. The stator housing 2 is connected to the stator hub 34 by a plurality of stator vanes 36. The stator hub 34 gradually decreases in radius in the aft direction to form a bullet-shaped tail cone, starting out at a radius slightly less than the radius at the trailing edge of the impeller hub. The tail cone may comprise a separate piece attached to the stator hub. The stator vanes 36 are designed to redirect the swirling flow out of the impeller 4 into non-swirling flow, i.e., the stator vanes are designed to remove the rotating component from the water as it leaves the impeller and cause the water to flow directly rearward.

The stator housing 2 comprises an exit nozzle having an outlet 22. Alternatively, the exit nozzle can be formed as a separate component which is attached to the stator housing. Although not shown in FIG. 1, it will be readily appreciated by persons skilled in the art that a steering nozzle can be pivotably mounted to the stator housing or exit nozzle for steering the boat by redirecting the flow exiting the nozzle outlet 22. Similarly, a reverse gate can be pivotably mounted to the steering nozzle, stator housing, or exit nozzle for shifting the boat into reverse by reversing the flow exiting the steering nozzle. Structures for providing steering and shifting capability are well known in the art and are not discussed in detail herein.

Figure 2:
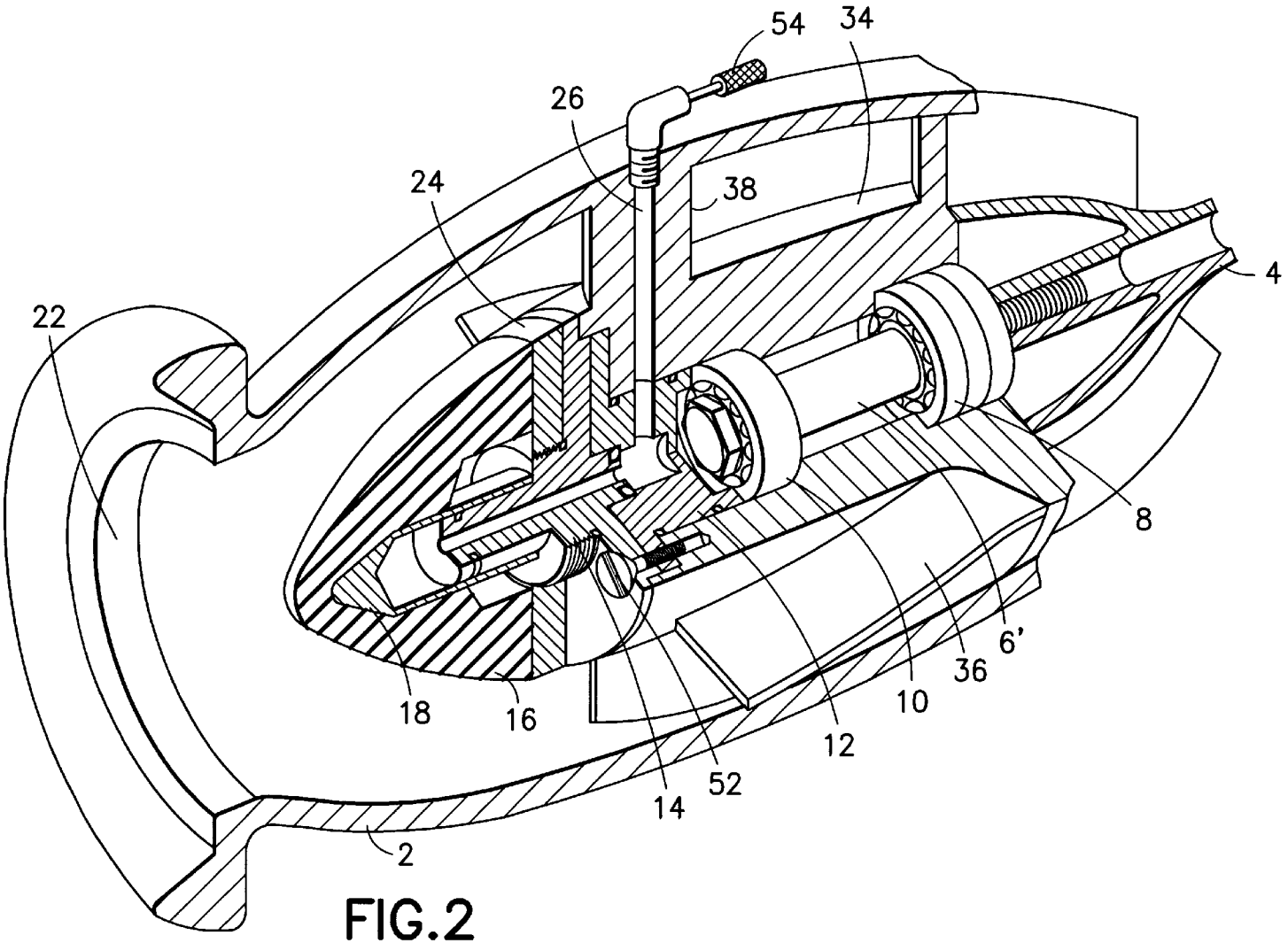
FIG. 2 is a schematic showing a partial isometric sectional view of a water jet propulsion device in accordance with the preferred embodiment of the invention.

The preferred embodiment of the present invention is depicted in FIG. 2. For the sake of simplicity, only relevant parts of the water jet propulsion unit are shown. The person skilled in the art will recognize that the unit shown in FIG. 2 can be mounted to a water tunnel and driven by an inboard motor, or can be mounted to and driven by an outboard motor. Furthermore, although not shown in FIG. 2, it should be apparent that either the stator housing 2 is extended to function as a housing for the impeller 4 or a separate impeller housing can be provided. In addition, the housing may comprise a separate inlet housing for the intake of water. In other words, the housing for the water jet propulsion system may comprise one unitary structure which functions as an inlet housing, an impeller housing, a stator housing and an exit nozzle, or may comprise separate components.

Referring to FIG. 2, the water jet propulsion unit in accordance with the preferred embodiment comprises a stator housing 2 having an exit nozzle with an outlet 22. A stator hub 34 is connected to (and supported by) the stator housing 2 by means of a plurality of stator vanes 36 and a strut 38. The stator hub 34 has an axial bore in which an impeller shaft is rotatably mounted via respective sets of bearing 8 and 10. The bearings are held in place by a bearing retainer 12. A threaded end of the impeller shaft 6' is coupled to the hub of the impeller, which is also threadably coupled to the output end of a drive shaft (not shown in FIG. 2).

In accordance with the preferred embodiment of the invention, means for adjusting the size of the outlet 22 of the exit nozzle are mounted to the stator hub 34 by means of a plurality of screws 52, only one of which is visible in FIG. 2. The adjusting means comprise a bullet-shaped tail cone 16 made of resilient or elastic material, e.g., molded rubber, and a hollow piston 18 which is axially slidable relative to the stator hub 34. The piston 18 is slidably mounted on an axial cylinder 28 of a cone retainer 14, the piston 18 and cylinder 28 forming a chamber between the distal end of the cylinder and the inner wall of the hollow piston. That chamber is in flow communication with a source (not shown) of fluid, e.g., hydraulic oil, via a hydraulic pressure line 26, which comprises respective conduits formed in the bearing retainer 12, the stator hub 34 and the strut 38.

Figure 3:
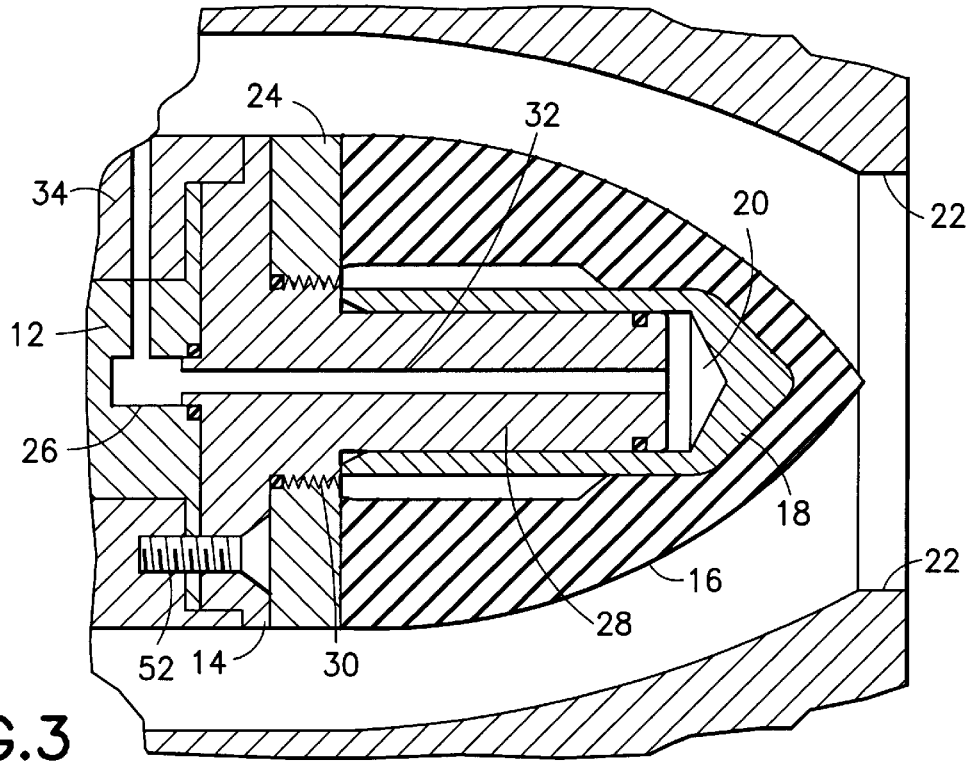
FIGS. 3 and 4 are schematics showing partial sectional views of the rear portion of the water jet propulsion device in accordance with the preferred embodiment, with the adjustable means being shown in a retracted state (FIG. 3) and an extended state (FIG. 4).

In accordance with the preferred embodiment, the tail cone 16 comprises a bullet-shaped molded piece of resilient or elastic material, e.g., rubber. As best seen in FIG. 3, the base of the cone is attached to an annular base plate 24, e.g., by vulcanization in the case where the cone is molded rubber. The cone has a recess, the opening of which is surrounded an annular base of the cone, the latter being attached to the base plate 24. The piston 18 is passed through the base plate 24 and fitted into a recess in the elastic tail cone 16.

As used herein, the term "cone" means a cone of revolution or any other shape which is suitable for use inside the exit nozzle of a water jet propulsion system. The preferred mathematical definition of the term "cone of revolution" is "the surface obtained by rotating a line around another line which it intersects, using the intersection point as a pivot. For example, a curved line can be rotated about a centerline axis which it intersects to generate the bullet-shaped tail cone of the preferred embodiment.

As shown in FIG. 3, the base plate 24 is coupled to the cone retainer 14 by threads 30 and comprises an annulus which lies flat against an annular flange of the cone retainer 14. The cone retainer further comprises an axially aligned cylinder 28. The hollow piston 18 is slidably mounted over the cylinder 28. The tail cone 16 is preferably molded so that the portion of its inner surface which adjoins the distal end of the piston generally conforms to the shape of and fits snugly around the piston distal end, whereas the portion of its inner surface which surrounds the remaining portion of the piston (not including the distal end portion) does not contact the piston. The cone retainer 28 comprises an axial conduit 32, which is preferably coaxial with the centerline axis of the cylinder. The conduit 32 has an inlet at the base of the cone retainer 14 and an outlet at an end of the cylinder 28. The cone retainer 14 is attached to the stator hub 34 in such a manner (e.g., by screws 52) that the inlet of conduit 32 is in flow communication with the outlet of the hydraulic pressure line 26. In the preferred embodiment, the outlet forms part of the bearing retainer 12. The outlet of conduit 32 is in flow communication with a chamber 20 inside the hollow piston 18.

Figure 4:
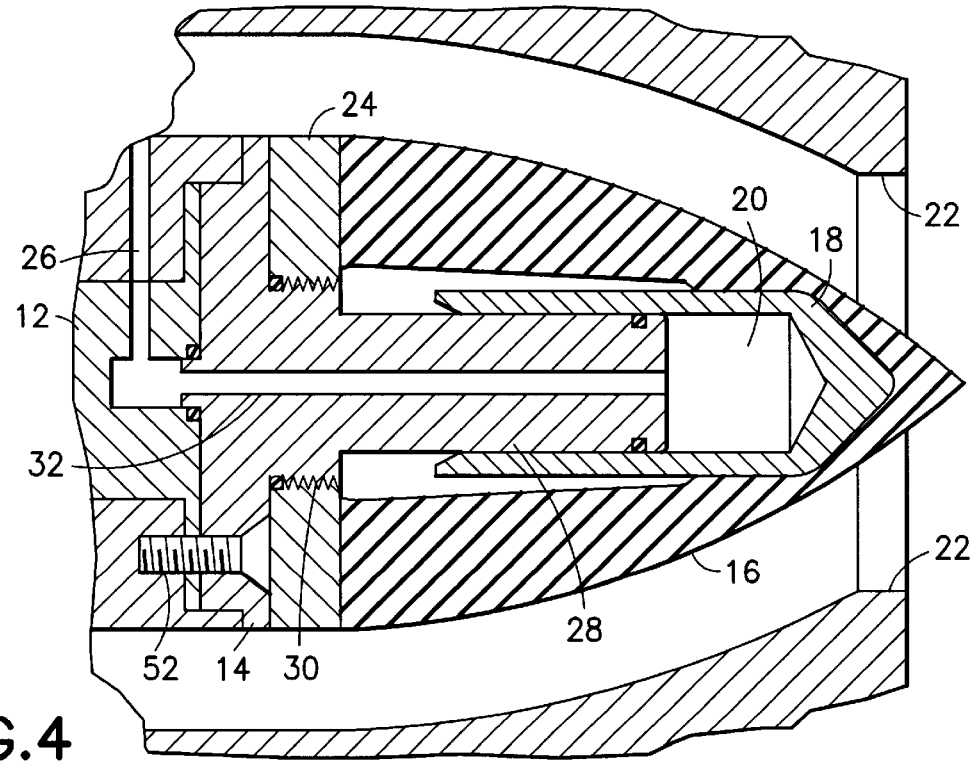

The piston 18 is hydraulically activated by supplying pressurized fluid to the chamber 20 via conduit 32 and hydraulic pressure line 26. The axial pressure exerted by the fluid in the chamber 20 causes the piston 18 to slide axially rearward from the retracted position shown in FIG. 3 to the extended position shown in FIG. 4. During rearward axial travel of the piston 18 from its retracted position to its extended position, the tip of the piston bears against the internal surface of the elastic tail cone 16 and carries the tip of the tail cone with it. This causes the elastic cone 16 to stretch and flex as the tip of the tail cone travels axially rearward while the base of the tail cone remains stationary. FIG. 4 shows the elastic tail cone in an elongated state. The tail cone 16 and piston 18 are configured and sized so that when the piston travels from the retracted position to the extended position, the extent to which the tip of the tail cone 16 protrudes into the exit nozzle outlet 22 is increased. Since the outer diameter of the tail cone increases from the tip forward, as the tip travels rearward, a tail cone portion of increasing diameter enters the exit nozzle outlet, thereby efficiently reducing the area of the nozzle outlet.

The elastic nature of the tail cone material will cause the cone 16 to return to its unelongated configuration when the hydraulic pressure is relieved, e.g., by opening a hydraulic valve 54 (shown in FIG. 2), thereby increasing the area of the nozzle outlet.

As seen in FIG. 3, O-rings can be installed in annular recesses to seal the interfaces between the piston 18 and the cylinder 28, between the base plate 24 and the cone retainer 14, and between the cone retainer 14 and bearing retainer 12.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "housing" comprises one or more attached parts having an inlet and an outlet for flow-through of fluid. For example, the "housing" may comprise a water tunnel or inlet housing, an impeller duct or housing, a stator housing, and an exit nozzle. However, the present invention encompasses forming all of these components as one piece or separate components. For example, the stator housing and the exit nozzle may be formed as one piece or separate components. All such variations fall within the meaning of "housing" as that term is used in the claims.

What is claimed is:

1. A water jet apparatus comprising:

a flow-through housing comprising a nozzle having an outlet;

a hub installed inside said housing;

a shaft having an end extending inside said hub;

an impeller mounted to said shaft;

a bearing for rotatably supporting said shaft in said hub;

a tail cone supported by said hub and located in the region of said nozzle, said tail cone being made of a material having an elasticity comparable to that of rubber; and a mechanism for changing the geometric shape of said tail cone.

2. The water jet apparatus as recited in claim 1, wherein said mechanism comprises a piston and said tail cone comprises a recess, said piston being situated within the confines of said recess and comprising an end in contact with an internal surface forming part of said recess of said tail cone.

3. The water jet apparatus as recited in claim 1, wherein said tail cone has an outer surface in the shape of a cone of revolution having a diameter which decreases in a rearward axial direction.

4. The water jet apparatus as recited in claim 1, further comprising a cone retainer attached to said hub, said cone retainer comprising a cylinder on which said piston slides.

5. The water jet apparatus as recited in claim 4, wherein said cylinder comprises a conduit having an outlet at an end of said cylinder.

6. The water jet apparatus as recited in claim 5, wherein said housing comprises a conduit which is in flow communication with said conduit in said cylinder.

7. The water jet apparatus as recited in claim 6, further comprising a bearing retainer attached to said hub for retaining said bearing, wherein said bearing retainer comprises a conduit, said conduit in said housing being in flow communication with said conduit in said cylinder via said conduit in said bearing retainer.

8. The water jet apparatus as recited in claim 4, further comprising an annular base plate which is coupled to said cone retainer, wherein said tail cone comprises a base attached to said base plate.

9. The water jet apparatus as recited in claim 1, wherein said tail cone is made of molded rubber.

10. A water flow apparatus comprising:

a duct comprising a nozzle having an outlet;

a hub installed inside said housing and arranged to provide an annular flow region between said hub and said housing;

a tail cone supported by said hub and located in the region of said nozzle, said tail cone being made of a material having an elasticity comparable to that of rubber; and a mechanism for changing the geometric shape of said tail cone.

11. The water flow apparatus as recited in claim 10, wherein said mechanism comprises a piston and said tail cone comprises a recess, said piston being situated within the confines of said recess and comprising an end in contact with an internal surface forming part of said recess of said tail cone.

12. The water flow apparatus as recited in claim 10, wherein said tail cone has an outer surface in the shape of a cone of revolution having a diameter which decreases in a rearward axial direction.

13. The water flow apparatus as recited in claim 10, further comprising a cone retainer attached to said hub, said cone retainer comprising a base and a cylinder on which said piston slides.

14. The water flow apparatus as recited in claim 13, wherein said cylinder comprises a conduit having an inlet at said base and an outlet at an end of said cylinder.

15. The water flow apparatus as recited in claim 10, further comprising an annular base plate which is coupled to said cone retainer, wherein said tail cone comprises a base attached to said base plate.

16. The water flow apparatus as recited in claim 10, wherein said tail cone is made of molded rubber.

17. A water jet apparatus comprising:

a flow-through housing comprising a nozzle having an outlet;

a hub installed inside said housing;

a shaft having an end extending inside said hub;

an impeller mounted to said shaft;

a bearing for rotatably supporting said shaft in said hub;

an actuator which is axially movable relative to said hub; and a hollow elastic member comprising a first portion which is stationary relative to said hub and a second portion which is stationary relative to said actuator, said hollow elastic member being in an unelongated state when said actuator is in a retracted position and an elongated state when said actuator is in an extended position, said nozzle outlet and said elastic member defining a first outlet area when said elastic member is in said unelongated state and a second outlet area when said elastic member is in said elongated state, said second outlet area being different than said first outlet area.

18. The water jet apparatus as recited in claim 17, wherein said second outlet area is less than said first outlet area.

19. The water jet apparatus as recited in claim 17, wherein said actuator comprises a piston.

20. The water jet apparatus as recited in claim 19, wherein said elastic member comprises a recess for receiving said piston.

21. The water jet apparatus as recited in claim 19, wherein said piston comprises a recess, further comprising means for producing hydraulic pressure in said recess of said piston.

22. The water jet apparatus as recited in claim 21, further comprising a bearing retainer attached to said hub for retaining said bearing, wherein said hydraulic pressure producing means comprise a conduit in said bearing retainer.

23. The water jet apparatus as recited in claim 19, further comprising a cone retainer attached to said hub, said cone retainer comprising a cylinder on which said piston slides.

24. The water jet apparatus as recited in claim 23, wherein said hydraulic pressure producing means comprise a conduit having an outlet at an end of said cylinder.

25. The water jet apparatus as recited in claim 23, further comprising an annular base plate which is coupled to said cone retainer, wherein said elastic member comprises a base attached to said base plate.

26. The water jet apparatus as recited in claim 17, wherein said elastic member comprises a tail cone made of molded rubber.

27. A device for varying an area of an outlet of a nozzle having an axis, comprising:

an actuator which is axially movable relative to said nozzle; and a hollow elastic member comprising a first portion which is stationary relative to said nozzle and a second portion which is stationary relative to said actuator, said hollow elastic member being in an unelongated state when said actuator is in a retracted position and an elongated state when said actuator is in an extended position, said nozzle outlet and said elastic member defining a first outlet area when said elastic member is in said unelongated state and a second outlet area when said elastic member is in said elongated state, said second outlet area being different than said first outlet area.

28. The device as recited in claim 27, wherein said second outlet area is less than said first outlet area.

29. The device as recited in claim 27, wherein said actuator comprises a piston.

30. The device as recited in claim 29, wherein said elastic member comprises a recess for receiving said piston.

31. The device as recited in claim 29, wherein said piston comprises a recess, further comprising means for producing hydraulic pressure in said recess of said piston.

* * * * *